United States Patent [19]

Guth

[11] 4,417,978

[45] Nov. 29, 1983

[54] CENTRIFUGAL SCREENING DEVICE

[76] Inventor: Karl V. L. Guth, Estrada Velha de Araucaria Km 1, Na Cidade de Curitiba, no Estado do Parana, Brazil

[21] Appl. No.: 287,537

[22] PCT Filed: Jan. 24, 1979

[86] PCT No.: PCT/BR79/00001

§ 371 Date: Sep. 24, 1979

§ 102(e) Date: Sep. 24, 1979

[87] PCT Pub. No.: WO79/00547

PCT Pub. Date: Aug. 23, 1979

[51] Int. Cl.[3] ..... B07B 1/20

[52] U.S. Cl. ..... 209/306; 209/411; 209/413; 99/574; 209/407

[58] Field of Search ..... 209/306, 270, 273, 283, 209/395, 275, 289, 305, 293, 406, 407, 411, 412, 413, 303, 304; 210/117, 415, 484, 452, 489, 507, 508, 497.01, 499; 99/574; 55/498, 501, 511, 510

[56] References Cited

U.S. PATENT DOCUMENTS

| | | | |
|---|---|---|---|
| 288,745 | 11/1883 | Tustin | 209/407 X |
| 319,574 | 6/1885 | Gathmann | 209/306 |
| 380,348 | 4/1888 | Prinz | 209/395 X |
| 676,645 | 6/1901 | Arnold | 209/283 |
| 788,219 | 4/1905 | Ogle | 209/306 |
| 1,784,219 | 12/1930 | Brennan | 209/306 |
| 1,897,624 | 2/1933 | Seitz | 209/289 |
| 2,458,113 | 1/1949 | Stevens | 209/412 X |
| 2,576,794 | 11/1951 | Jost et al. | 209/412 X |
| 2,738,065 | 3/1956 | Mahlkuch | 209/306 X |
| 4,105,543 | 8/1978 | Seifert | 209/273 X |

FOREIGN PATENT DOCUMENTS

| | | | |
|---|---|---|---|
| 694442 | 12/1930 | France | 209/306 |
| 761631 | 11/1956 | United Kingdom | 209/306 |

*Primary Examiner*—Richard L. Chiesa

*Attorney, Agent, or Firm*—Robert E. Burns; Emmanuel J. Lobato; Bruce L. Adams

[57] ABSTRACT

A centrifugal screening device comprises a cylindrical screen surrounded by a cylindrical casing spaced radially from the screen. A central shaft inside the screen carries a plurality of blades which are inclined so that material fed into one end of the space between the shaft and screen is thrown toward the screen by centrifugal force and is also propelled axially of the screen to an exit at the other end. Fine material passing through the screen is collected in a funnel at the lower end. The screen is made up of semicylindrical sections each comprising a frame in which metal mesh is secured by strips of woven synthetic resin material.

14 Claims, 12 Drawing Figures

CENTRIFUGAL SCREENING DEVICE

BACKGROUND OF THE INVENTION

The need of good screening in the processing of cereals represents a primary fact for obtaining final product and by-product. Cereals, such as wheat, rye, corn and others, require a processing of multiple sequential phases that lead to high purity final products, one seeking to obtain a maximum of flour extraction and a minimum of sub-products or by-products, namely, bran.

To attain such results, very complex systems and processes are necessary, with the use of several types of machines each performing a specific operation with a consequent need of several phases for cereals processing. A general scheme, shown by FIG. 12, depicts one of the possible phases to which the cereal to be transformed can be subject. Initially there are cylinders (A) through which the product enters and where the initial milling of the raw product is carried out. After the product is ground, it is carried by pneumatic raising assembly (B) which introduces said product into screens (C). These screens are composed of a series of several-mesh nylon screens through which the products subdivide and reach a new phase of processing. Such new phase begins in another cylinder going or not through intermediate blenders (D) the purpose of which is to prepare the product better for the following phase. The process will be repeated as many times as it is necessary until one obtains the maximum of extraction of the cereal to be transformed, it being pointed out that in many phases it is necessary to use removers (E) the function of which is to eliminate possible scales that are formed during the milling.

SUMMARY OF THE INVENTION

It should be noted that such systems and processes are highly complex, requiring a very costly installation. The solution for this problem would be a machine capable to carry out all such operations at the same time, that is: the product leaving the cylinder would pass through the machine and reach final products and by-products, eliminating the pneumatic conveyor, the screening, the division, the removal, the intermediate blenders and simplifying the processing phases. Concerned with these facts, the applicant has developed the subject machine which carries out the operations of transport, several types of screening, division and removal. With the employment of this new concept, the pneumatic conveyor assembly and the respective cyclones, the removers, the several types of screens and intermediate blenders can be eliminated.

Another important item comprises utilizing such new concept in already-existing classic systems, processing entire phases, increasing the overall capability, not needing, therefore, a new system but using the existing one, the new machine being arranged at any point of the process.

The aims of the applicant in the subject patent application refer to a new concept of centrifugal screening through rotative blenders surrounded by a cylindrical screen jacket composed of multiple individually removable boards, which processes the screening of all the products of an entire phase of the industrialization process and that can be employed in all the phases. In any of such phases final products are obtained and the machine can simultaneously carry out the raising, screening, division and removal of the products.

It is convenient to point out that the process is not similar to any other systems known heretofore, it having the quality of novelty constituting notable technological progress. It can have industrial application and its utilization will facilitate and simplify greatly the screening in the industrialization of cereals.

BRIEF DESCRIPTION OF DRAWINGS

Now this new concept will be explained in all of its details and for better illustration of the present specification, references will be made to the attached drawings in which a screening device in accordance with the invention is schematically represented.

DESCRIPTION OF PREFERRED EMBODIMENTS

The machine comprises two head assemblies connected by four "T-shaped" irons (1) located symmetrically forming a circular area and with the purpose to support the structure (2) of the machine which is formed by removable doors set and attached to the "T" irons (1) by means of simple snap locks allowing total access to the multiple semi-circular screens boards responsible for the screening of the cereals.

Figure 1:
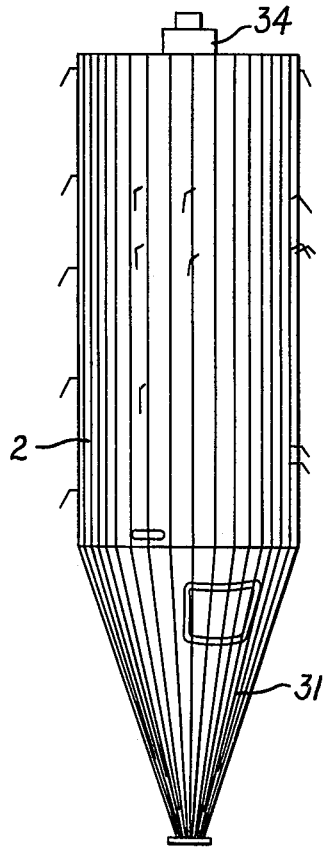
FIG. 1 is an external view of the structure.
Figure 2:
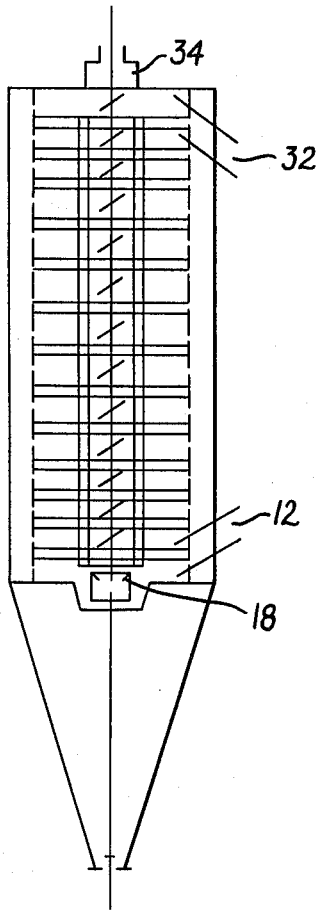
FIG. 2 is an internal view of the structure of FIG. 1.
Figure 3:
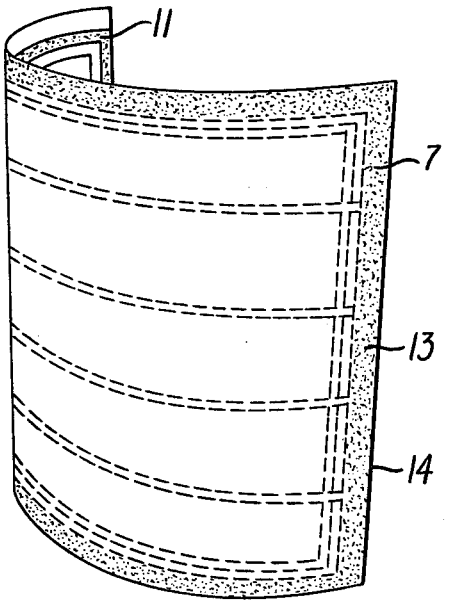
FIG. 3 is a general view of the cylindrical screens jacket composed of multiple semi-cylindrical boards that can be individually removed.
Figure 4:
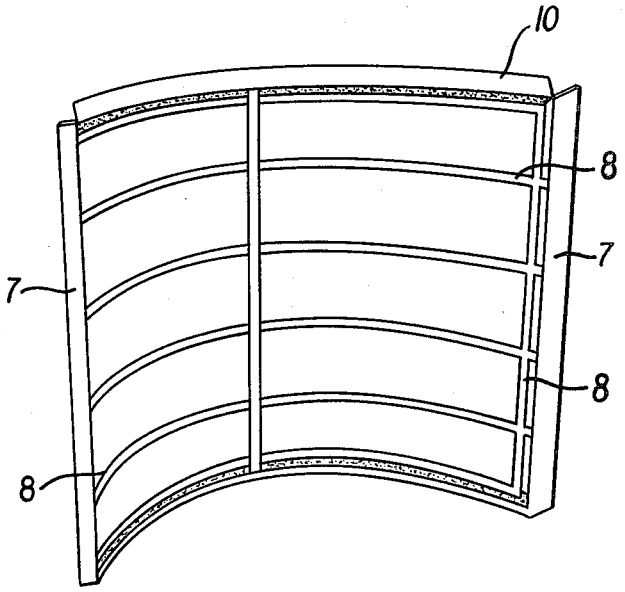
FIG. 4 is a view of the screen boards showing the semi-rims and angles supporting them.
Figure 5:
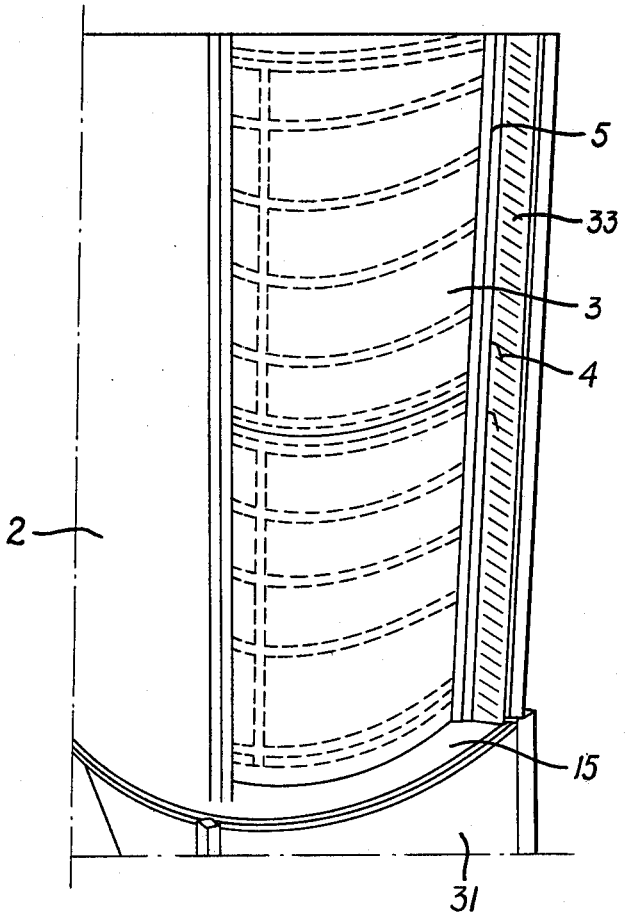
FIG. 5 is a perspective view illustrating how the screen is mounted on the structure.
Figure 6:
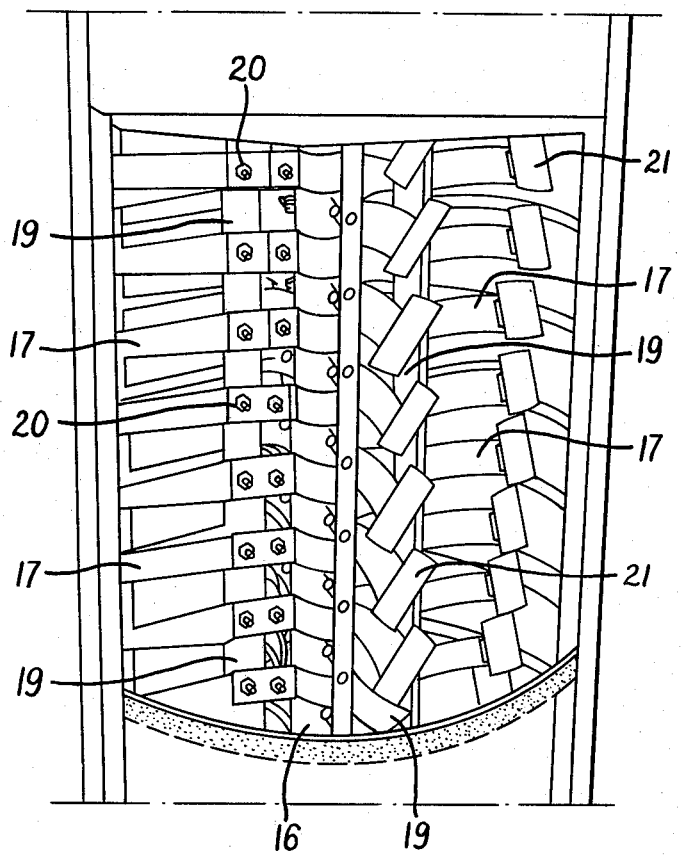
FIG. 6 is a schematic view of the blenders shaft for large diameters.
Figure 7:
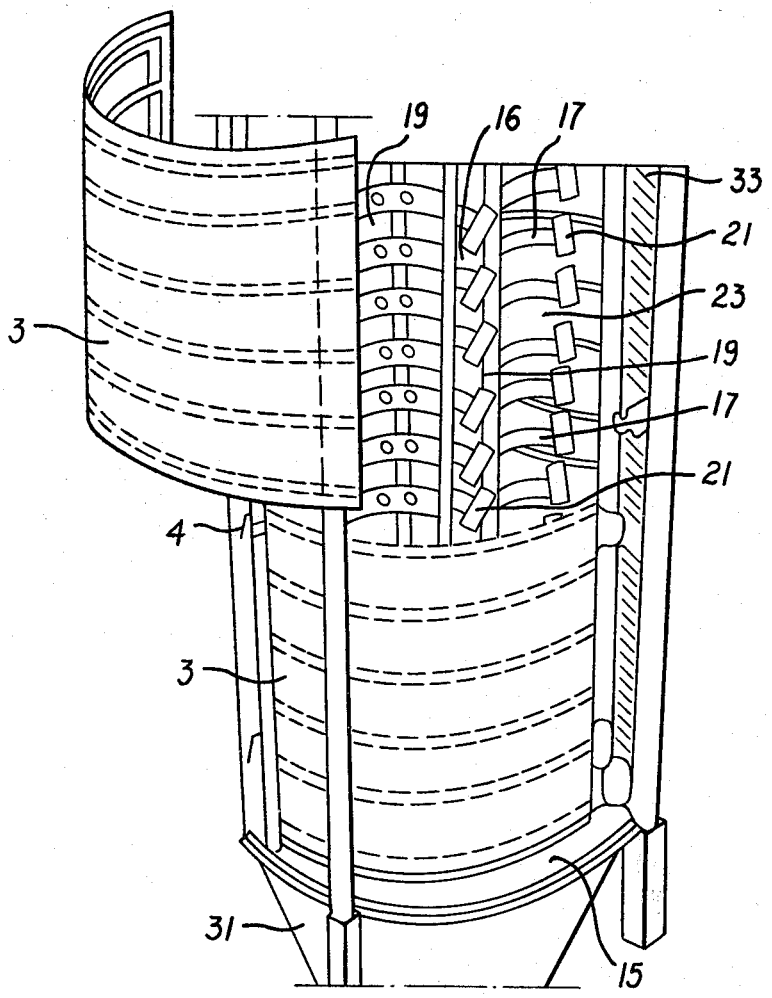
FIG. 7 is a view like FIG. 6, but also showing the screens.
Figure 8:
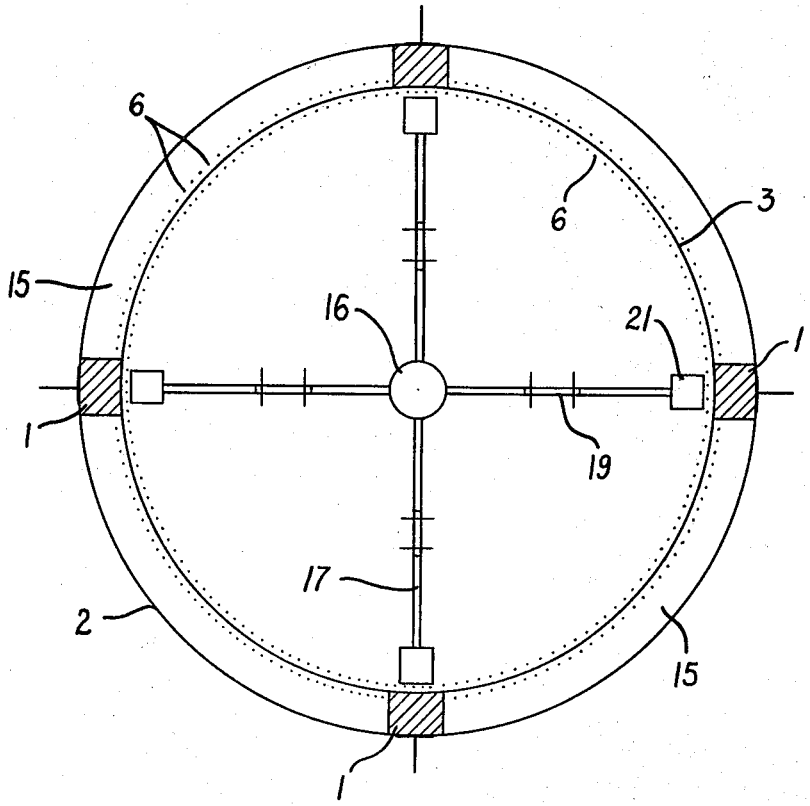
FIG. 8 is a schematic plan view of the blenders shaft.
Figure 9:
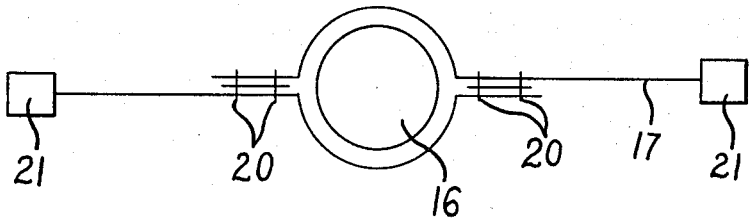
FIG. 9 is a detail of attachment of the blenders to the shaft.

The semi-circular screen boards (3) are attached by snap locks (4) to two intermediate irons (5), also in the form of a "T", which are, in turn, bolted to the internal ring (6) and welded to the head assemblies. The present invention is characterized by the plurality of individually removable boards that compose the cylindrical screens jacket, which, due to the plurality of boards, are subject to selection as to the number of types of meshes suitable to the several mesh measurements. The cylindrical screen jacket can be composed of several meshes as shown in the divisions of FIG. 3, as well as it improves the systems of frame of the screens in the respective boards. Each board, which forms a semi-circle, is composed of two longitudinal angles (7) united by two, three, four or more semi-rims (8) of flat irons welded to the angles (7). The boards are superposed usually in number of 4 or in greater number, it depending on the desired screening, and they are attached by snap locks (4) to the intermediate T-shape irons (5) as previously described. For engagement in the superpositions, the boards will have in the upper part thereof an external ring (10) sheet metal welded or riveted to the semi-rim coated with felt (11) to fixate the superposed board and seal the junction.

As pointed out previously, the system to assemble the screens to the boards is totally new. For such assembly, the angles (7) and the semi-rims (8) of the boards ends are drilled (13) in convenient spaces through which drilled holes the screen is properly nailed to the external side of the board. This system easily allows the partial or total replacement of the screen in the place the machine is installed.

Finally, in order to prevent the breaking of the steel screen caused by the vibration caused by the impact of the product thereto, if the screen were stretched and attached directly to the frame, a polyester fabric strip having flexibility and proved durability is secured to the screen at the four sides and nailed to the frame absorbing the vibrations, and in its turn-the strip (14) being protected by the sheet metal ring absorbing the impact of the products, said ring being bolted or riveted on the internal side of the fabric strip on small shims that preserve the flexibility of the strip.

Having thus described the type of structure and the screen board responsible for the screening of the product, the mechanism by means of which the product will pass through the machine will be described.

Initially there is a central shaft (16) to which the blenders (17) are bolted, said shaft (16) being supported on the lower head assembly by a thrust bearing (18) which supports the weight of the shaft (16) and another ordinary bearing similar to that one of the head assembly. In order to assure the perfect running of the shaft (16) and provide proper stiffness to the shaft (16), four flat irons or angles (19) are bolted to all the blenders (17) so as to form solid structure, eliminating the need of an intermediate bearing.

The blenders (17) are made of resilient iron or similar material and are attached to the shaft in two parts, bolted to the shaft by two bolts (20) on each side of the shaft and superposed so as to form 90 -degree angles with respect to each other. From the last attaching bolt to the end, said blenders (17) are twisted to the desired helical degree for advance or transport of the product and are drilled adjacent the ends where an iron plate (21) is bolted, in an elongate bore, for adjustment of the distance to the metallic screen, said plate being broader to eliminate any void between the superposed blenders.

Figure 10:
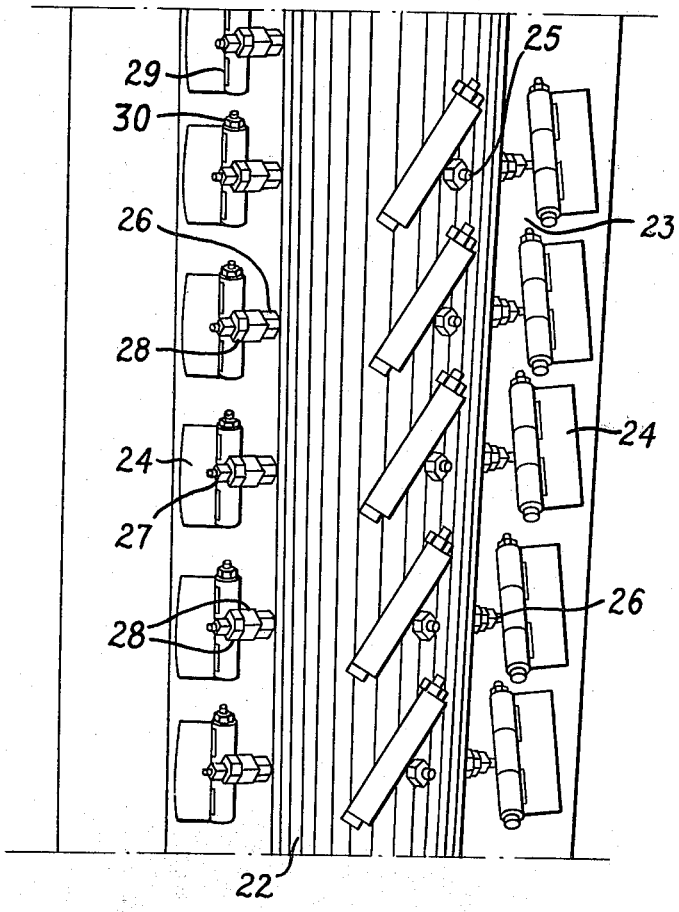
FIG. 10 is a schematic view of the blenders shaft for smaller diameters.

In case of utilization of small diameters and great lengths of the machine as illustrated in FIG. 10, a new type of shaft has been envisaged which shaft presents the same characteristics and functional principles as the old one, but in this case the shaft (22) of the shaft or spindle (23) is made of seamless steel tube, and the blenders (24) have triple adjustment, that is: the tube (22) is drilled through as shown in FIG. 10 in symmetric distances, a threaded circular iron bar (25) being passed from the edge of the tube to the end, which bar is tightened, for attachment, by a nut (26) on each side of the tube (22).

Figure 11:
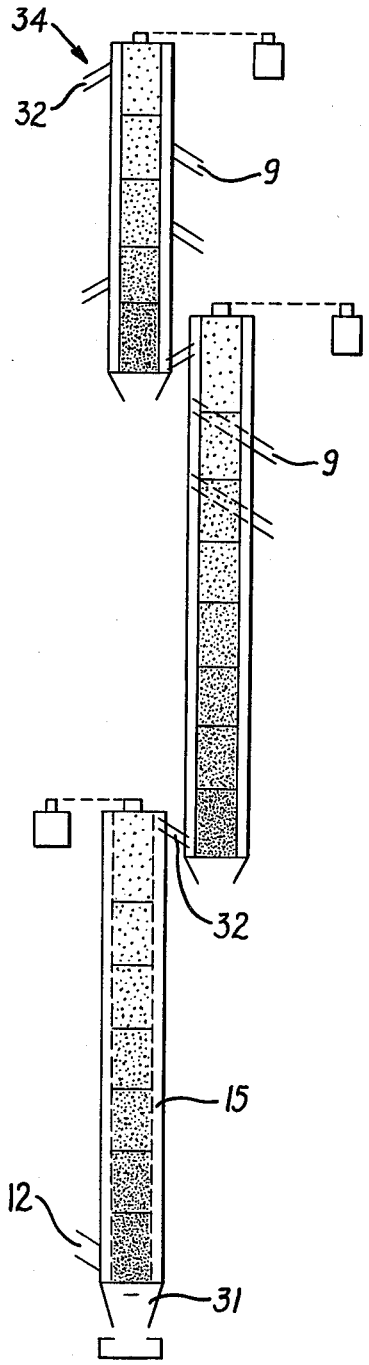
FIG. 11 is a schematic view of the utilization of several machines for great lenghts.
Figure 12:
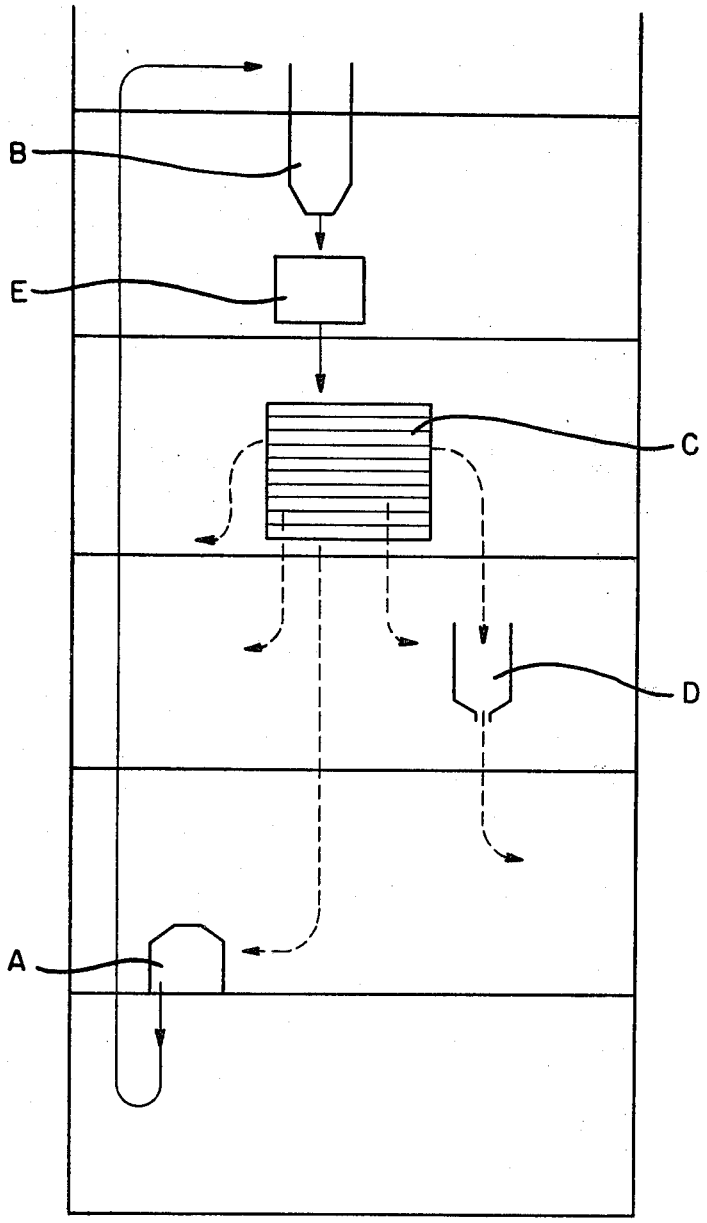
FIG. 12 is a schematic view of the classic systems and processes.

To attach the blender (24), which is welded to a square nut (27), the iron bar (25) is followed by another nut (28) on each side of the blender for adjustment of the distance from the end of the blender to the screen (3) and also to adjust the vertical advance inclination. The inclination of the blender (24) which directs the product towards the screen, is made by the bolt (29) and lock nut (30). In the case that the machine processes a production phase requiring several divisions as illustrated in FIG. 11, a gutter-shaped sheet-metal, felt-or rubber-sealed collar (9) is mounted around the screen (3) and sloped to the external door, the collar having a 30° to 50° slope that passes through the door for ejection of the product; next, the section that carries out the division of the product can be mounted horizontally, this option further facilitating the approach of the product to the next machine in the processing.

The entrance (12) of the product to be screened is in the lower part of the machine, the fine product being screened first, then going through the screen and falling into the annular zone (15) existing between the structure (2) and the cylindrical jacket composed of multiple screen boards (3) of semi-circular shape, passing through the openings in the lower head assembly of the machine, and reaching the funnel (31). The product of greater mesh size that did not pass through the screen is ejected from the upper part (32) of the machine.

However, in the cases that divisions are concerned, the products of the subsequent mesh sizes, in accordance with the sizes of the screens, are ejected from the gutter-shaped collars (9) and from the upper exit of the machine.

One can further invert the procedure, that is, the product is admitted by the upper head assembly (34) and ejected from the lower head assembly by simply inverting the rotation of the blenders shaft or, further by inversely twisting the blenders. The machine can also be mounted horizontally.

The raising of the product beyond six meters, although it can be made by one single machine with connected shafts and intermediate internal bearings, is preferably carried out in two, three, or four steps as shown in FIG. 11, thus avoiding connected shafts and internal bearings, each part having only one rolling bearing in each head assembly, and a thrust bearing in the lower head assembly, all of them being duly sized and easily reachable. The driving is individual by means of an electric motor, through a belt in the upper head assembly. The upper exit (32) of the machine is provided with an opening covered by a sheet metal cover held on the upper part with a shaft or two pins that can rotate easily in case of clogging in the product flow beyond the machine. The machines, which are supplied in modules in order to provide great length, have their structures reinforced by an iron arc divided into four parts bolted to the "T" irons at symmetric distances. The attachment of the machine is made by means of bolts that hold it on angles welded to the floor and walls at proper distances.

The versatility of the present invention must be pointed out for besides being capable to be utilized in all phases of the industrialization process,including the first phase, always obtaining final products and alleviating noticeably the subsequent phases of the processing, the machine being capable of being made in several different sizes, so that it is possible to suit it to the availability of space in already-existing installations, and with the characteristic that it can be mounted vertically or horizontally.

The new concept and great advantage of the present invention reside in the fact that it can carry out simultaneously, besides screening, the raising, division and removal of the product in one single machine, consequently eliminating the utilization of the machines utilized in the classic schemes of industrialization, it being also characterized by the simplicity and lightness of the structure supporting it, by the external doors which are easily and totally removable by simply operating the snap locks, permitting total access to the screen jacket; by the innovation of the composition of the screens jackets constituted of multiple boards and removable by simple snap locks; by the innovation of the new concepts of blenders-shafts; as well as by the idealization of a systems of several exists is of products by gutter-shaped collars.

I claim:

1. A centrifigual screening device for screening cereal produces comprising:

a cylindrical casing comprising upper and lower circular heads, a plurality of outer uprights extending between said heads and a plurality of arcuate casing sections fitting between said outer uprights and removably secured thereto by snap locks, a cylindrical screen inside said cylindrical casing and spaced inwardly therefrom to provide a first annular zone therebetween, said cylindrical screen comprising a plurality of inner uprights extending between said heads and a plurality of arcuate screen sections fitting between said inner uprights and removably secured thereto by snap locks, each of said screen sections comprising an arcuate frame and a parti-cylindrical sieve fitting in said frame and secured at its periphery to said frame by a flexible fabric strip absorbing vibration of said sieve, said fabric strip being protected from impact of the product by a metal strip secured on the internal face of said fabric strip in a manner to preserve flexibility of said fabric strip, a central longitudinal shaft rotatably mounted axially of said cylindrical screen with a second annular zone between said shaft and said screen and with a product inlet at a lower end of said second annular zone and a product outlet at the upper end of said second annular zone, a plurality of plates carried by and rotatable with said shaft, said plates being in said second annular zone and being inclined with respect to their plane of rotation so that the product being screened is thrown against said cylindrical screen by centrifugal force and is propelled longitudinally of said second annular zone from said inlet towards said outlet, finer particles of said product passing through said screen from said second annular zone to said first annular zone, and funnel means at the bottom of said cylindrical casing for collecting and delivering product from said first annular zone.

2. A screening device according to claim 1 wherein each of said plates is mounted on a single arm projecting from and fixed to the shaft and is adjustable relative to said arm to vary the angle at which it is inclined to the plane of rotation.

3. A screening device according to claim 2, wherein each plate is pivotal about the axis of said arm which is normal to the longitudinal axis of said shaft.

4. A screening device according to claim 3, wherein each plate is also pivotal about a second axis which is normal to the axis of said arm.

5. A screening device according to claim 2, 3 or 4, wherein each plate is adjustable radially of said arm so as to be moved towards or away from said screen.

6. A screening device according to claim 1, wherein said cylindrical screen has mesh sizes which differ from one another axially of the device.

7. A screening device according to claim 1 wherein each of said plates is mounted on a resilient arm extending radially from said shaft.

8. A screening device according to claim 1, wherein said shaft comprises a steel tube drilled to receive arms on which said plates are mounted.

9. A screening device according to claim 1, wherein said cylindrical screen comprises a plurality of cylindrical portions disposed end-to-end and of increasing mesh size in the direction of passage of the material through said second annular zone, and wherein annular collars with discharge exits are disposed in said first annular zone between screen portions of different mesh size to collect and discharge material passing through said screen portions of different mesh size.

10. A screening device according to claim 1, in which a plurality of spaced horizontal arcuate ribs extend between and are welded to opposite vertical sides of the frame of each of said screen sections.

11. A screening device according to claim 10, in which at least one vertical rib crossing said horizontal ribs extends between and is welded to upper and lower horizontal sides of each of said screen sections.

12. A screening device according to claim 1, in which said plates are mounted on arms extending radially from said shaft and in which vertically aligned arms are interconnected by structural members extending parallel to the shaft to provide stiffness to the shaft.

13. A screening device according to claim 1, in which said plates are mounted on arms extending from the shaft, inner portions of said arms having a semicircular configuaration and two arms being bolted together with said semicircular protions embracing and gripping the shaft.

14. A screening device according to claim 1, in which said inlet and outlet open directly and freely into said second annular zone in which said plates are disposed whereby said product can freely enter and leave said second annular zone.

* * * * *